US006089925A

United States Patent [19]

Maltais et al.

[11] Patent Number: 6,089,925

[45] Date of Patent: Jul. 18, 2000

[54] MODULAR ELECTRICAL CONNECTOR HAVING ELECTRICAL CONTACT MODULES

[75] Inventors: Jay Frederick Maltais, Harrisburg; John Edward Prime, Jr., Manheim, both of Pa.

[73] Assignee: The Whitaker Corporation, Wilmington, Del.

[21] Appl. No.: 09/168,400

[22] Filed: Oct. 6, 1998

[51] Int. Cl.[7] ..... H01R 13/502

[52] U.S. Cl. ..... 439/701; 439/695; 439/686

[58] Field of Search ..... 439/686, 689, 439/688, 690, 629, 630, 631, 632, 636, 637, 634, 59, 60, 81, 82, 83, 695, 701

[56] References Cited

U.S. PATENT DOCUMENTS

| | | | |
|---|---|---|---|
| 3,680,032 | 7/1972 | Mosier et al. . | |
| 3,861,775 | 1/1975 | Makins | 339/17 |
| 3,923,364 | 12/1975 | Shapiro et al. . | |
| 4,586,254 | 5/1986 | Ammon et al. | 29/884 |
| 4,948,379 | 8/1990 | Evans | 439/329 |
| 4,959,030 | 9/1990 | Tatebe et al. | 439/67 |
| 4,990,107 | 2/1991 | Fortuna | 439/637 |
| 5,024,609 | 6/1991 | Piorunneck | 439/637 |
| 5,197,887 | 3/1993 | Davidge et al. | 439/60 |
| 5,201,661 | 4/1993 | Ii | 439/79 |
| 5,306,160 | 4/1994 | Roberts | 439/62 |
| 5,421,746 | 6/1995 | David | 439/701 |
| 5,466,162 | 11/1995 | Schroepfer et al. | 439/79 |
| 5,775,938 | 7/1998 | Noro et al. | 439/495 |
| 5,813,877 | 9/1998 | Nakamura | 439/267 |
| 5,876,214 | 3/1999 | Mchugh et al. | 439/60 |
| 5,921,785 | 7/1999 | Li | 439/60 |

*Primary Examiner*—Paula Bradley
*Assistant Examiner*—Truc Nguyen
*Attorney, Agent, or Firm*—Bradley N. Ditty

[57] ABSTRACT

The invention comprises a modular electrical connector assembly having a housing, a first contact module, a second contact module, and a retention member. The first and second contact modules house a plurality of contacts terminated to flexible etched circuits, or other conductors, which are routed out of the rear of the assembly. The first contact module is loaded into the housing proximate the mating end. The second contact module is loaded behind the first contact module within the housing. Both modules are then retained by a retention member inserted behind both modules. The mating end of the electrical connector assembly is configured to receive a printed circuit card edge.

20 Claims, 8 Drawing Sheets

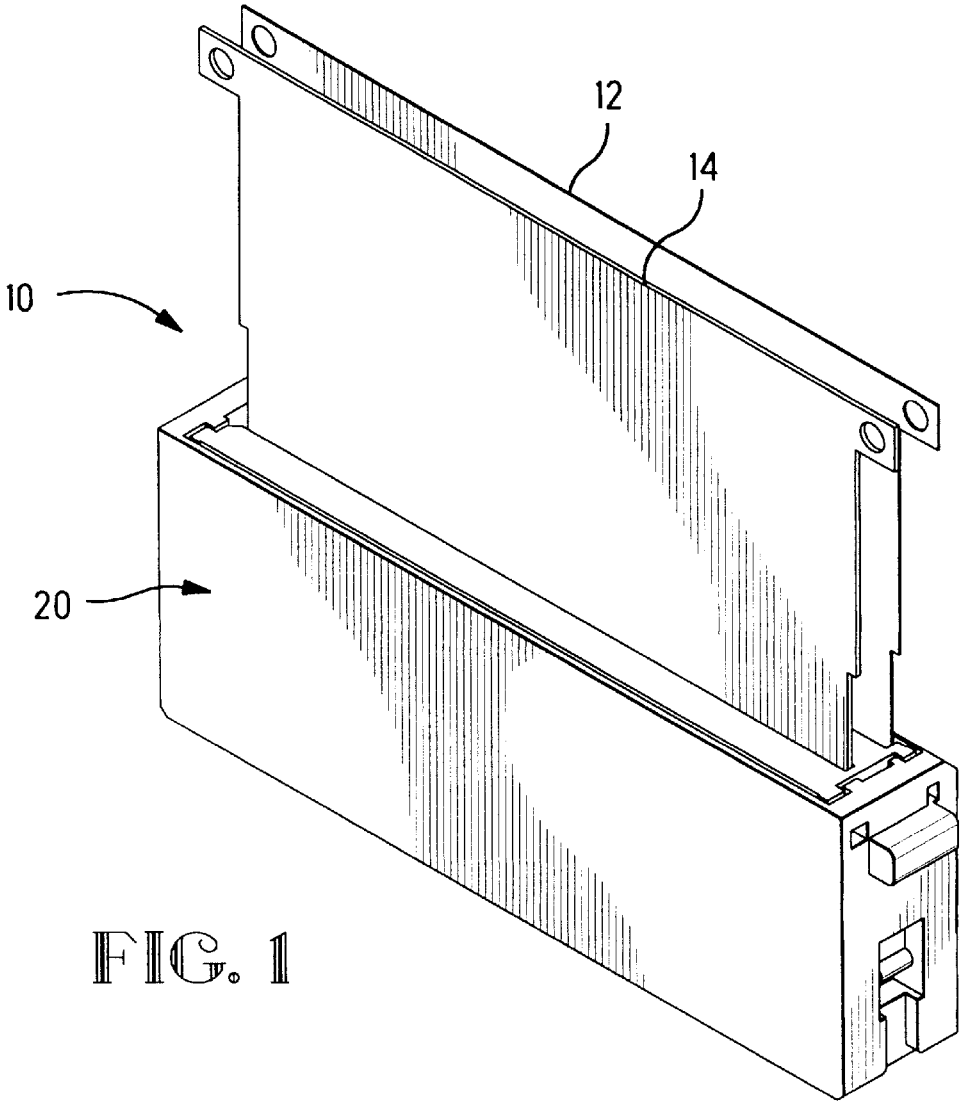
FIG. 1
FIG. 3
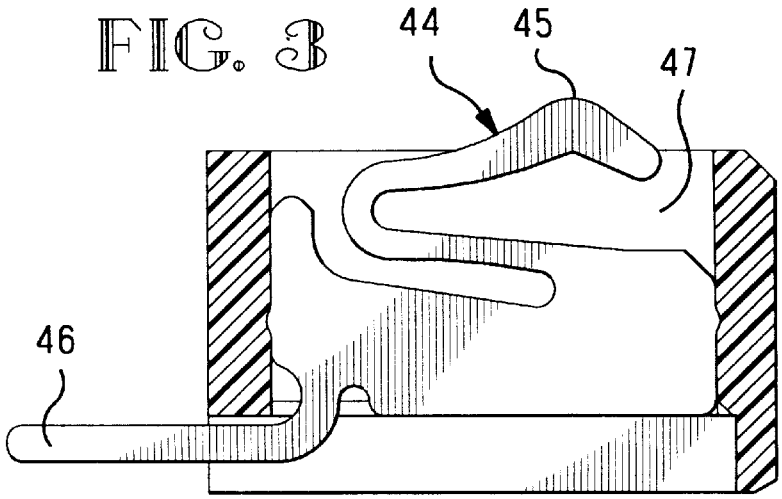

MODULAR ELECTRICAL CONNECTOR HAVING ELECTRICAL CONTACT MODULES

FIELD OF THE INVENTION

The invention is directed to a modular electrical connector assembly capable of receiving the edge of a printed circuit board or circuit card. The electrical connector is an assembly of contact modules arranged within a connector housing.

BACKGROUND OF THE INVENTION

Electrical connectors of the type receiving an edge of a printed circuit board or circuit card are well known. Typically, a slot is provided in an insulative housing of the electrical connector for accepting an edge of a board or circuit card. The card edge generally has a row or rows of conductive pads or traces on either or both sides of the board. The slot on the electrical connector housing leads to a contact area which is a narrow cavity flanked by one row or two opposing rows of electrical contacts.

In some instances, use of more than two opposing rows of contacts is necessary to accommodate the complexity of the circuitry of the circuit board which is to be received. As the complexity of the contact scheme within the electrical connector increases, problems arise in assembling the connector. Loading contacts within the electrical connector housing becomes more complex as does connecting the electrical contacts to conductors and routing those conductors within the electrical connector housing.

What is needed is an electrical connector for receiving a printed circuit board edge or circuit card edge which is easily assembled, of minimal size and superior electrical performance.

SUMMARY OF THE INVENTION

The present invention provides an electrical connector capable of receiving a circuit card edge or printed circuit board edge comprising a housing having a mating end and a rear end. The mating end has a card receiving slot and the rear end has an opening leading to an internal cavity. A first contact module is disposed within the internal cavity proximate a mating end and houses a plurality of electrical contacts. Each electrical contact has a solder tail and a contact portion wherein the contact portion is exposed on a side of the first contact module proximate the card receiving slot. Each solder tail is connected to a conductor which extends rearwardly through the opening in the rear end. A second contact module is disposed behind the first contact module within the internal cavity and houses a plurality of electrical contacts. Each electrical contact has a contact portion and a solder tail wherein the contact portion is exposed on a surface of the second contact module proximate the card receiving slot. Each solder tail is connected to a conductor which extends rearwardly through the opening of the rear end.

BRIEF DESCRIPTION OF THE DRAWINGS

An embodiment of the present invention will now be described in detail with reference to the accompanying drawings, in which:

FIG. 1 is an isometric view of the electrical connector assembly of the present invention;

FIG. 3 is a cross sectional view of the first contact module shown in FIG. 2;

DETAILED DESCRIPTION OF THE INVENTION

Figure 2:
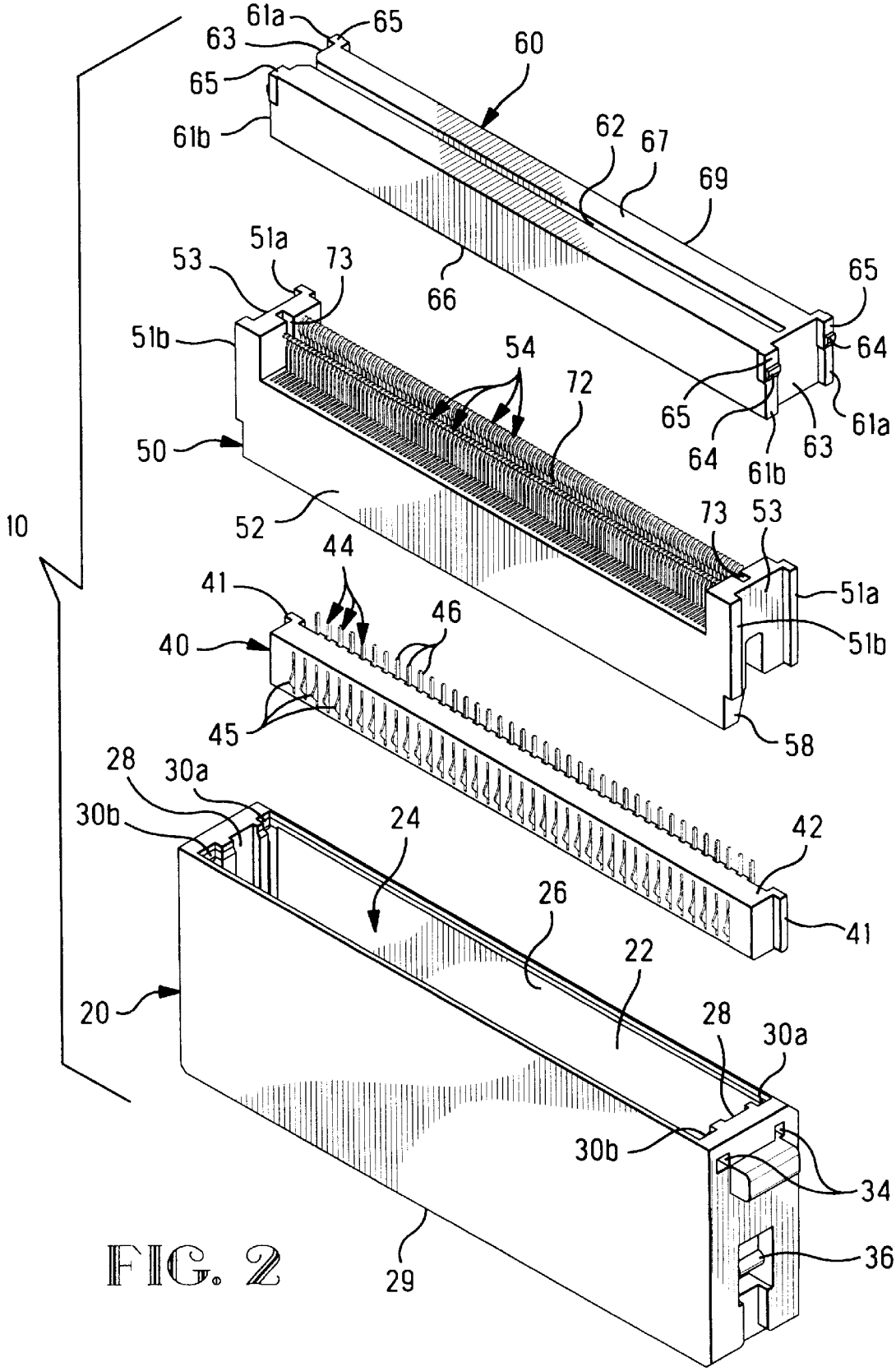
FIG. 2 is an exploded isometric view of the electrical connector assembly of the present invention.
Figure 12:
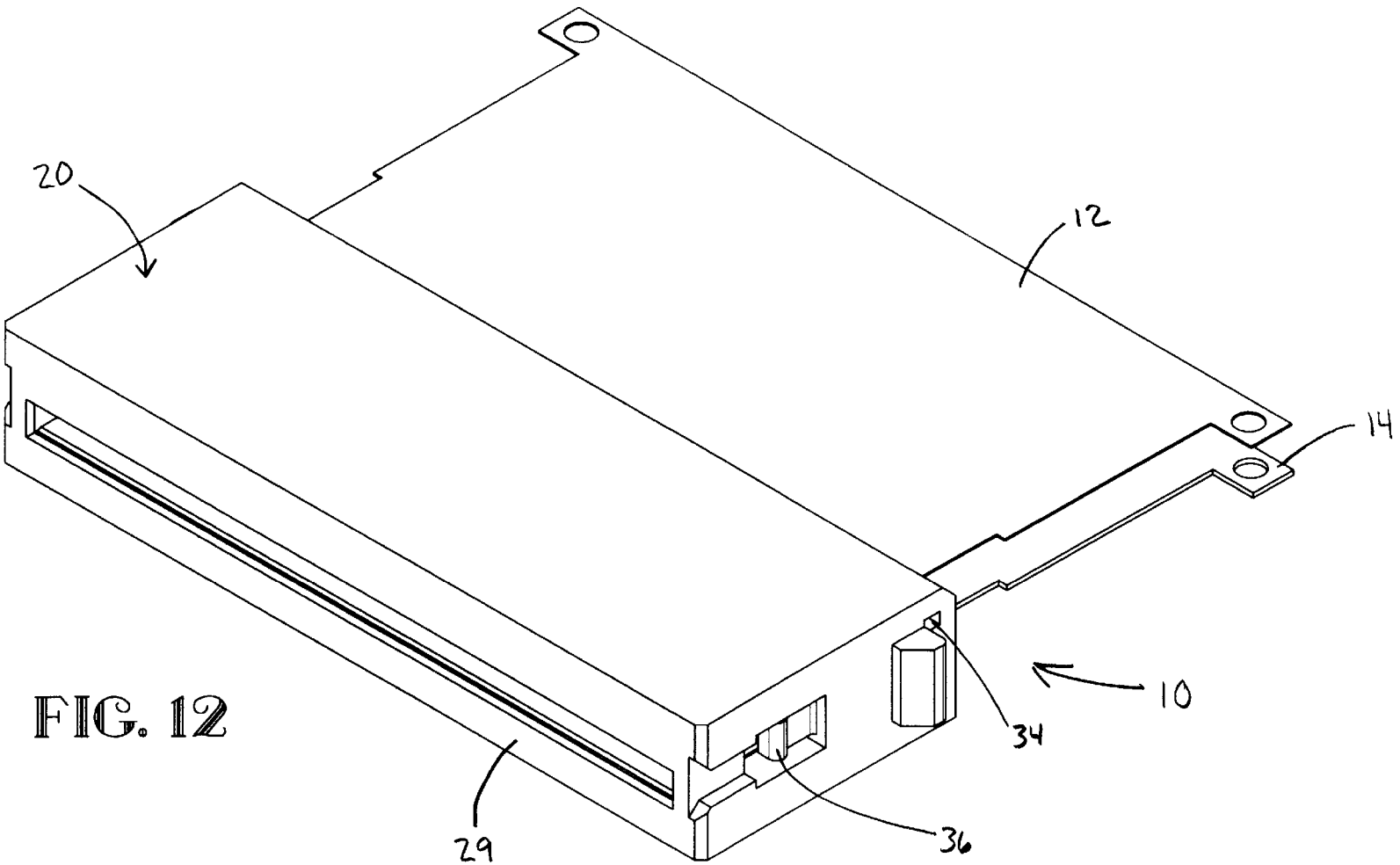
FIG. 12 is an isometric view of the fully assembled electrical connector assembly of the present invention.

FIG. 1 shows an electrical connector assembly 10 of the present invention having flexible etched circuitry 12, 14 leading into the electrical connector housing 20. FIG. 2 shows an exploded isometric view of the component parts of electrical connector assembly 10. Specifically, electrical connector housing 20 is shown having a rear opening 22 which leads into internal cavity 24. Internal cavity 24 is bounded by both opposing sidewalls 26 and opposing end walls 28. A first groove 30*a* and a second groove 30*b* extend along the length of both end walls 28 from the rear opening 22 toward the front face 29 (best shown in FIG. 12).

A first contact module 40 is also shown in FIG. 2 having an elongated contact housing 42 loaded with an array of electrical contacts 44. A second contact module 50 is also shown comprised of a contact housing 52 which retains two opposing rows of electrical contacts 54. Finally, a retention member 60 is provided for installation behind second contact module 50 within rear opening 22.

Figure 4:
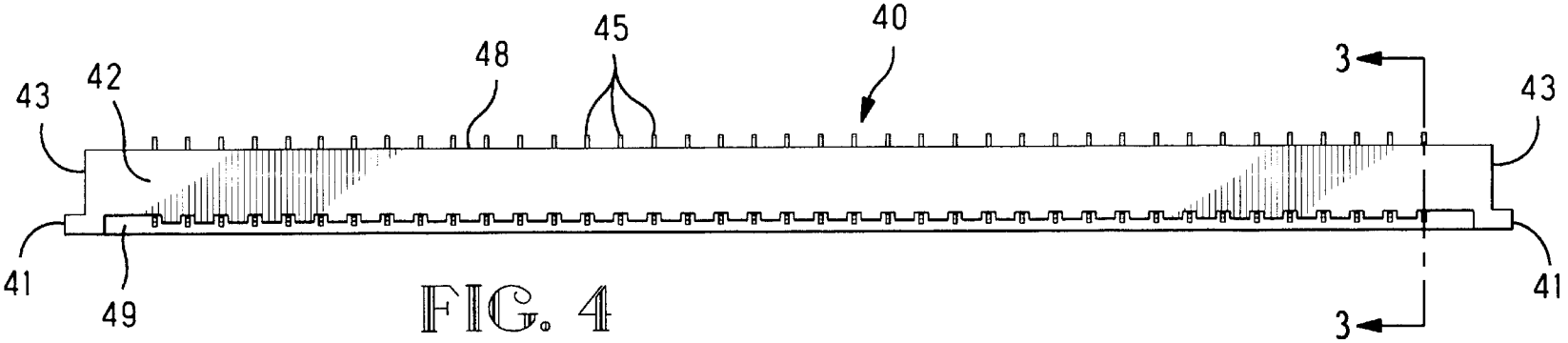
FIG. 4 is a side view of the first contact module shown in FIG. 2.

As shown in FIG. 2, first contact module 40 houses a row of electrical contacts 44 in an elongated contact housing 42. Electrical contacts 44 are comprised of contact portions 45 and solder tails 46 as best shown in FIG. 3. Each electrical contact 44 is received in contact receiving cavity 47 such that the contact portion 45 is exposed on a mating face 48 of the contact housing 42 while the solder tails 46 are received along the a recessed surface 49 located opposite the mating face 48, best shown in FIG. 4. First contact module 40 also provides tongues 41 located on each end 43 of contact housing 42. Tongues 41 provide guidance and retention of first contact module 40 by cooperating with first grooves 30*a* provided in the electrical connector housing 20.

Figure 5:
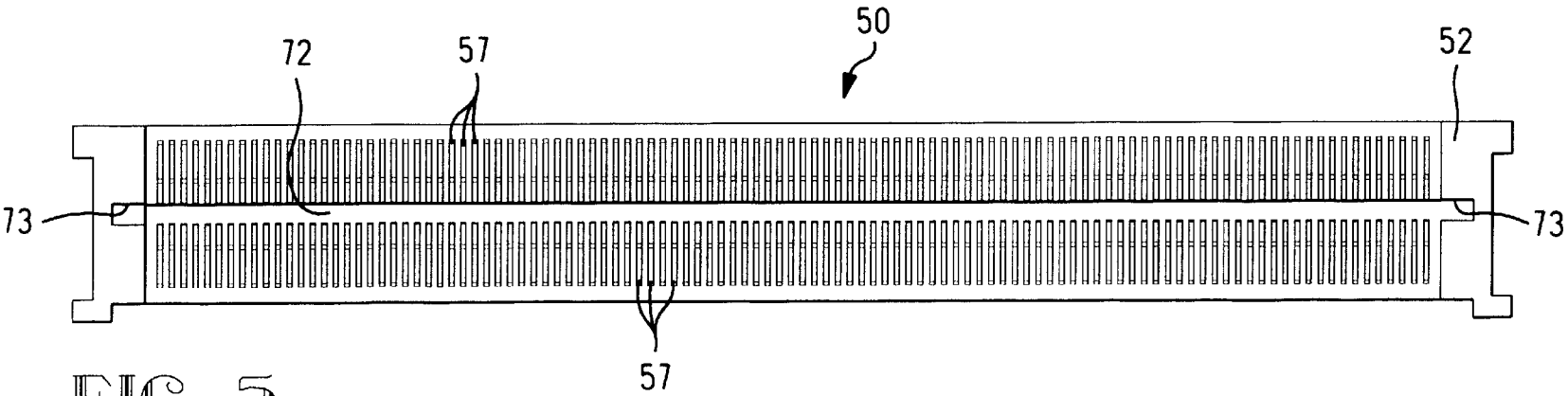
FIG. 5 is a rear view of the second contact module shown in FIG. 2.
Figure 6:
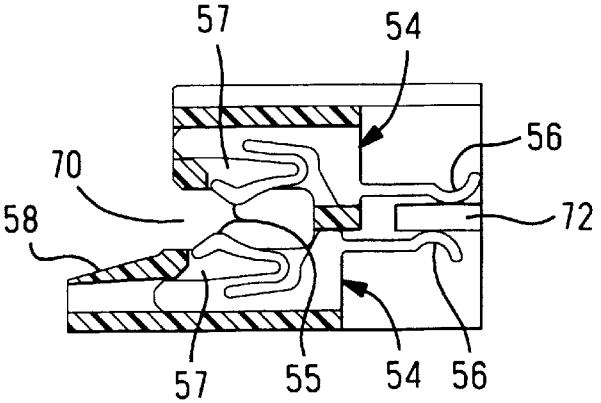
FIG. 6 is a cross-sectional view of the second contact module shown in FIGS. 2 and 5.

Second contact module 50 houses two opposing rows of electrical contacts 54 in electrical contact receiving cavities 57, as best shown in FIG. 5. Electrical contacts 54 are shown in FIG. 6 situated in respective contact receiving cavities 57 such that contact portions 55 oppose one another on each side of a card receiving slot 70. Similarly, solder tails 56 provided on each electrical contact 54 oppose one another in a central portion of the contact housing. As can be seen in FIG. 6, contacts 54 need not be situated in direct opposition, rather it may be desirable to stagger contacts 54 such that one row is forward the opposing row thereby reducing mating forces encountered when inserting the edge of a printed circuit board or circuit card. Similarly, contacts within the same row may be staggered in an alternating fashion to achieve lowered mating forces.

Figure 7:
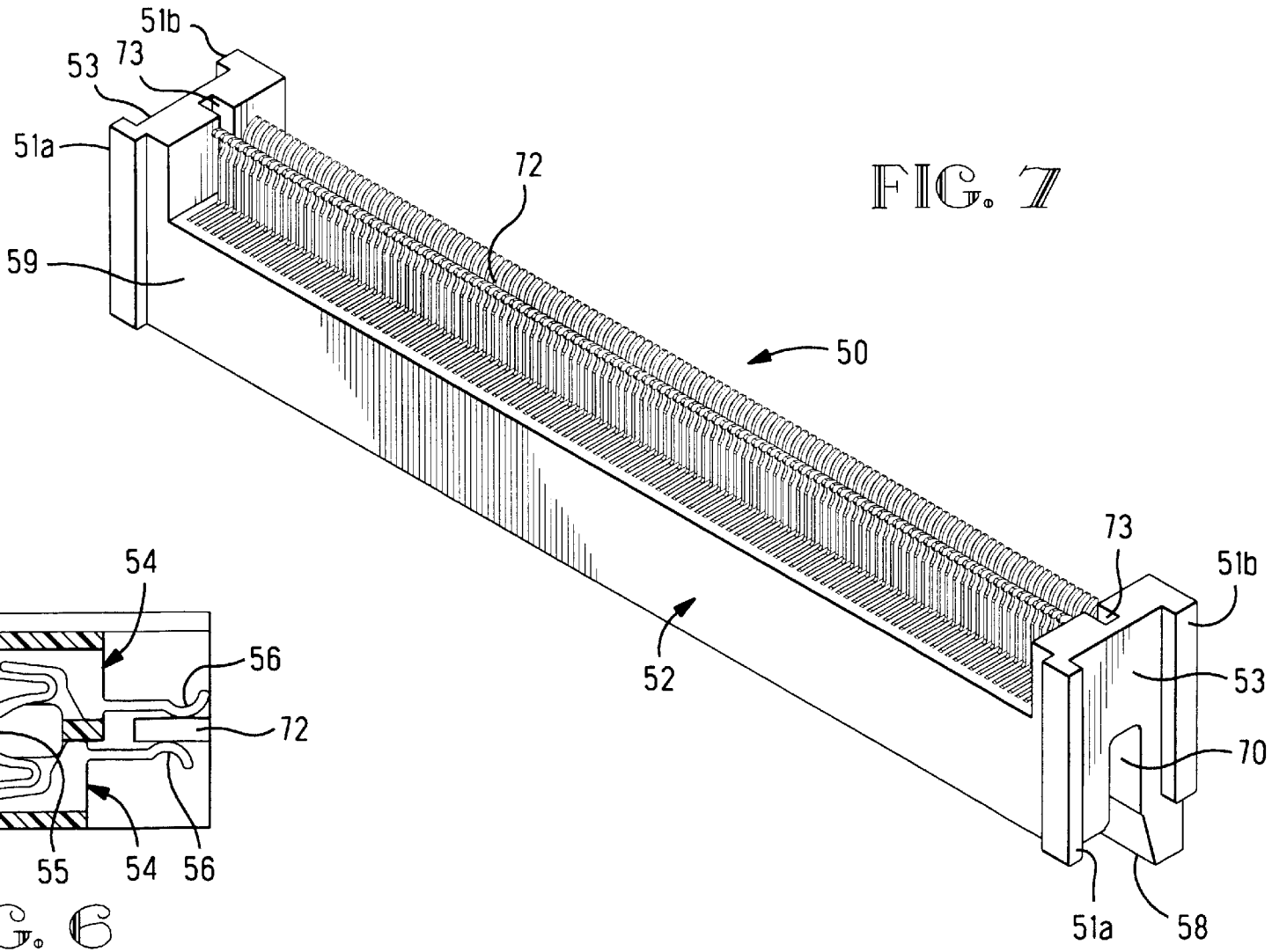
FIG. 7 is an isometric view of the second contact module.

FIG. 7 shows in greater detail features of second contact module 50 which assist in the modular assembly of electrical connector assembly 10. For example, the embodiment of the second contact module shown in FIG. 7 illustrates an elongated contact housing 52 having opposing ends 53 each having a pair of tongues 51*a* and 51*b*. Tongues 51*a* and 51*b* are configured so as to be accepted in grooves 30*a* and 30*b*, respectively, in housing 20. The cooperative arrangement of tongues 51*a* and 51*b* with grooves 30*a* and 30*b* provide the alignment and retention of second contact module 50 upon assembly of second contact module 50 behind first contact module 40 within electrical connector housing 20. A recessed surface 59 is also provided on contact housing 52 disposed between tongues 51*a*. This recessed surface 59 is arranged such that when electrical connector assembly 10 is fully assembled, recessed surface 59 is in alignment adjacent to recessed surface 49 located on contact housing 42 of first contact module 40. The cooperation of recessed surface 49 with recessed surface 59 allows passage for conductors which have been connected to solder tails 46 of electrical contact 44 between both first contact module 40 and second contact module 50 and sidewall 26 of electrical connector housing 20. For instance, a piece of flexible etched circuitry 12 may be electrically connected to solder tails 46 of electrical contacts 44 and routed between recessed surface 49, recessed surface 59 and sidewall 26 to allow flexible etched circuitry 12 to exit the electrical connector assembly 10.

Figure 8:
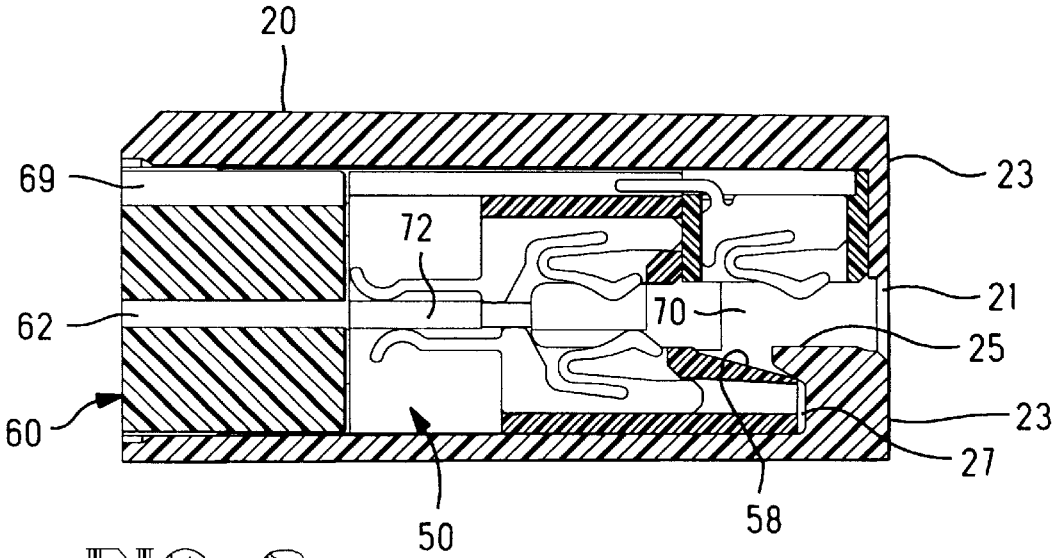
FIG. 8 is a cross-sectional view of the fully assembled components shown in FIG. 2.

FIG. 6 and 7 also depict a nose portion 58 extending along one side of card receiving slot 70 between tongues 51*a* and 51*b* of each end 53. This nose portion 58 is designed to further secure second contact module 50 within electrical connector housing 20. As best seen in FIG. 8, electrical connector housing 20 is provided with a front face 23 with a forward opening 21 leading to card receiving slot 70. An overhang 25 extending alongside card receiving slot 70 and projecting inwardly into internal cavity 24 is provided which defines an elongated recess 27 that receives nose portion 58 of second contact module 50 upon full assembly.

Finally, as best shown in FIGS. 5, 6, and 7 second contact module 50 is provided with a conductor receiving area 72 defined by opposing rows of solder tails 56. The present illustrated embodiment also provides channels 73 which are aligned on each end of the contact housing 52 with conductor receiving area 72. The conductor receiving area 72, in combination with channels 73, is designed to receive conductors for electrical connection to the solder tails 56 of electrical contacts 54. In the present embodiment, a piece of flexible etched circuitry 14 having conductive traces or pads 16 on both sides is disposed within conductor receiving area 72 and corresponding channels 73 for electrical connection to opposing rows of solder tails 56, best shown in FIG. 9.

Referring back to FIG. 2, retention member 60 is provided with tongues 61*a* and 61*b* at each end 63. Similar to second contact module 50, first tongues 61*a* are aligned to correspond with first tongues 51*a* of second contact module 50 and tongues 41 of first contact module 40. Second tongues 61*b* are similarly aligned behind second tongues 51*b* of second contact module 50. Thus, upon assembly of electrical connector 10, retention member 60 is received behind first and second contact modules 40 and 50, respectively, within electrical connector housing 20. The retention member 60 is therefore received in first and second grooves 30*a* and 30*b* and is seated within rear opening 22 of electrical connector housing 20.

Retention member 60 is also provided for routing conductors, for example flexible etched circuitry 12 and 14, through rear opening 22 and out of the electrical connector assembly 10. Retention member 60 is provided with a central conductor routing slot 62 extending from one end 63 into the retention member 60. The central conductor routing slot 62 passes through the retention member 60 from a forward face 66 to a rear face 67 such that the conductor routing slot 62 is in alignment with conductor receiving area 72 and channels 73 of second contact module 50. Upon assembling electrical connector assembly 10, conductor routing slot 62 allows conductors connected to solder tails 56, such as flexible etched circuitry 14, to pass through retention member 60 and thus exit the electrical connector assembly 10.

As with second contact module 50, a recessed surface 69 is provided between tongues 61*a* of each end 63. Recessed surface 69 is arranged to align with recessed surface 49 of first contact module 40 and recessed surface 59 of second contact module 50 so as to allow passage of conductors connected to solder tails 46, such as flexible etched circuitry 12, between first and second contact modules 40 and 50, retention member 60, and sidewall 26 of electrical connector housing 20.

In the present embodiment, first contact module 40 and second contact module 50 are retained within electrical connector housing 20 by retention member 60 secured by latching protrusions 64 located on each first and second tongues, 61*a* and 61*b*, respectively. Latching protrusion 64 are, upon full assembly, received within latching detents or openings 34 located within first and second grooves 30*a* and 30*b* of electrical connector housing 20. In addition, enlarged tongue portions 65 are located on first and second tongues 61*a* and 61*b* proximate the rear face 67. These enlarged tongue portions 65 are slightly larger in dimension than the portions of the first and second tongues 61*a* and 61*b* proximate the forward face 66 and are designed to interferingly engage grooves 30*a* and 30*b* of the housing 20, thereby snugly retaining retention member 60 within housing 20.

Finally, latches 36 are provided on the exterior of electrical connector housing 20 for latching engagement with a housing of a printed circuit board edge or card edge, not shown.

Figure 9:
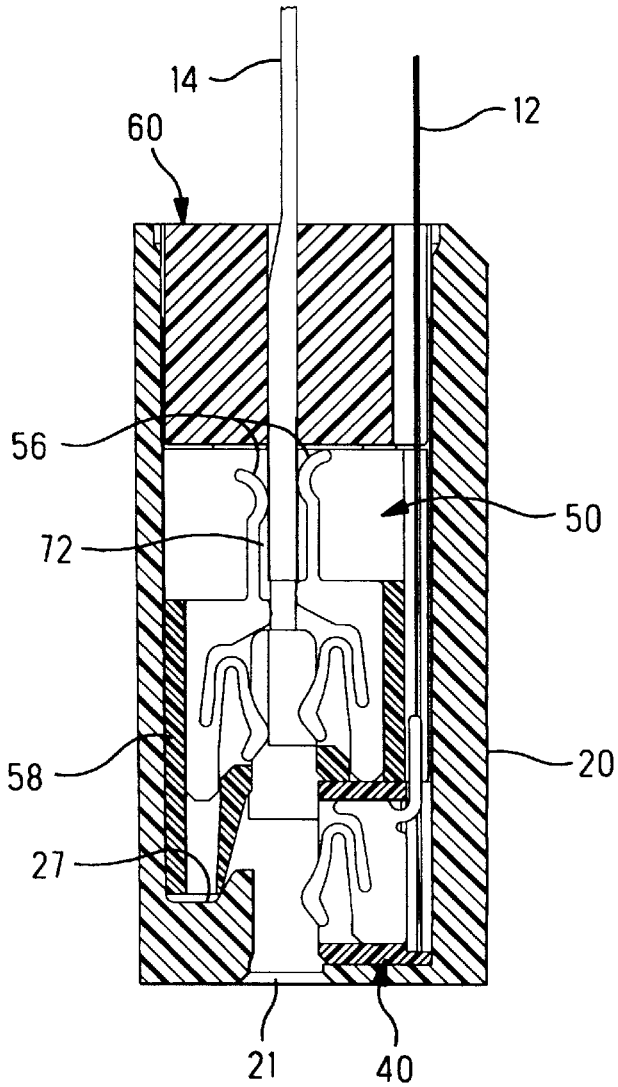
FIG. 9 is a cross-sectional view of the fully assembled electrical connector assembly shown in FIG. 1 with terminations to conductive members.

Referring now to FIG. 9, a cross-section of the fully-assembled electrical connector assembly 10 is shown. Within the electrical connector housing 20, first contact module 40 is loaded proximate forward opening 21. Inserted behind first contact module 40 is second contact module 50 abutting first contact module 40 while also seating nose portion 58 in recess 27. The retention member 60 is received behind both first and second contact modules, 40 and 50, thus securing them within electrical connector housing 20.

Figure 10:
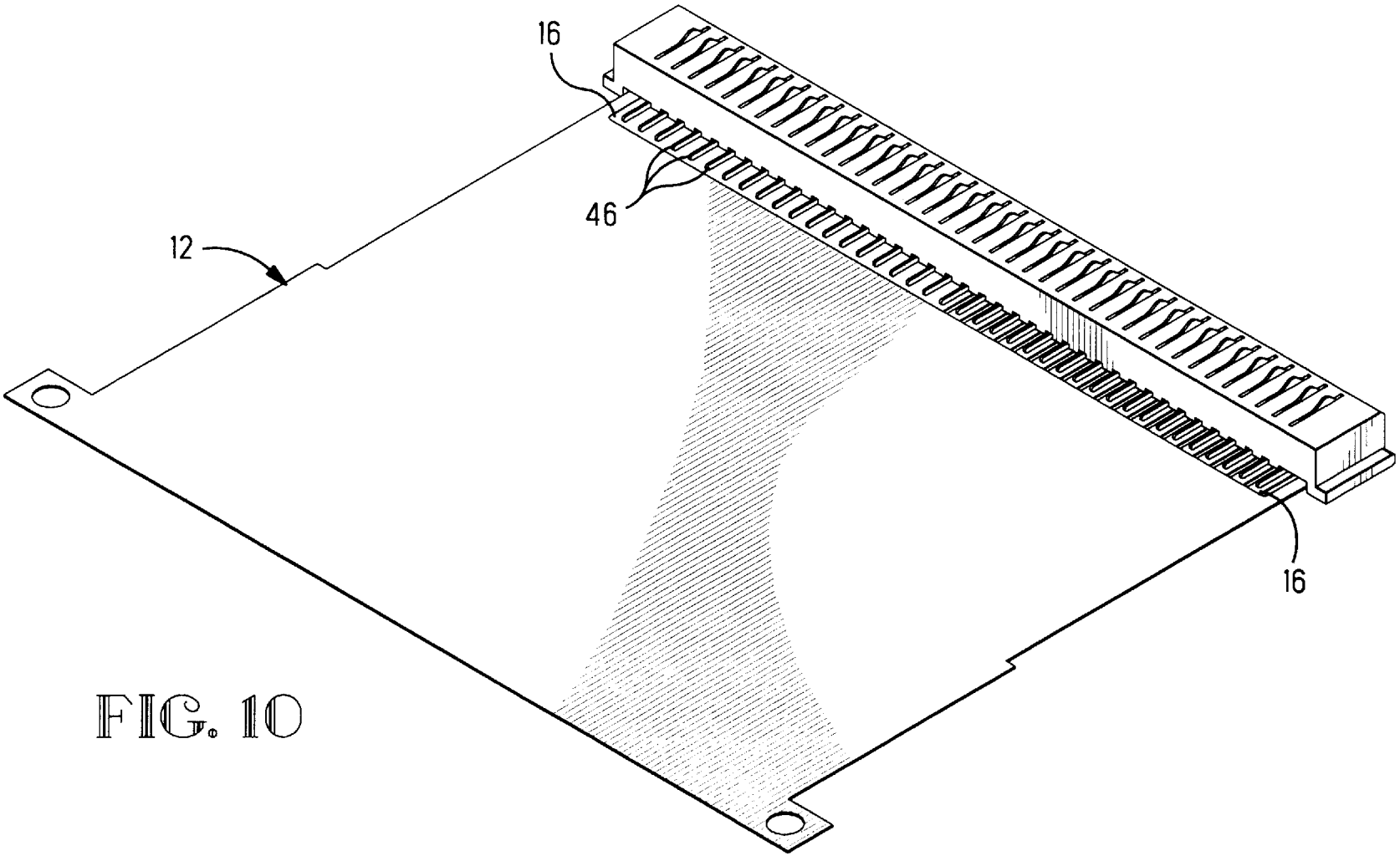
FIG. 10 is an isometric view of the first contact module shown in FIGS. 2 and 4 with a conductive member terminated to the electrical contacts.
Figure 11:
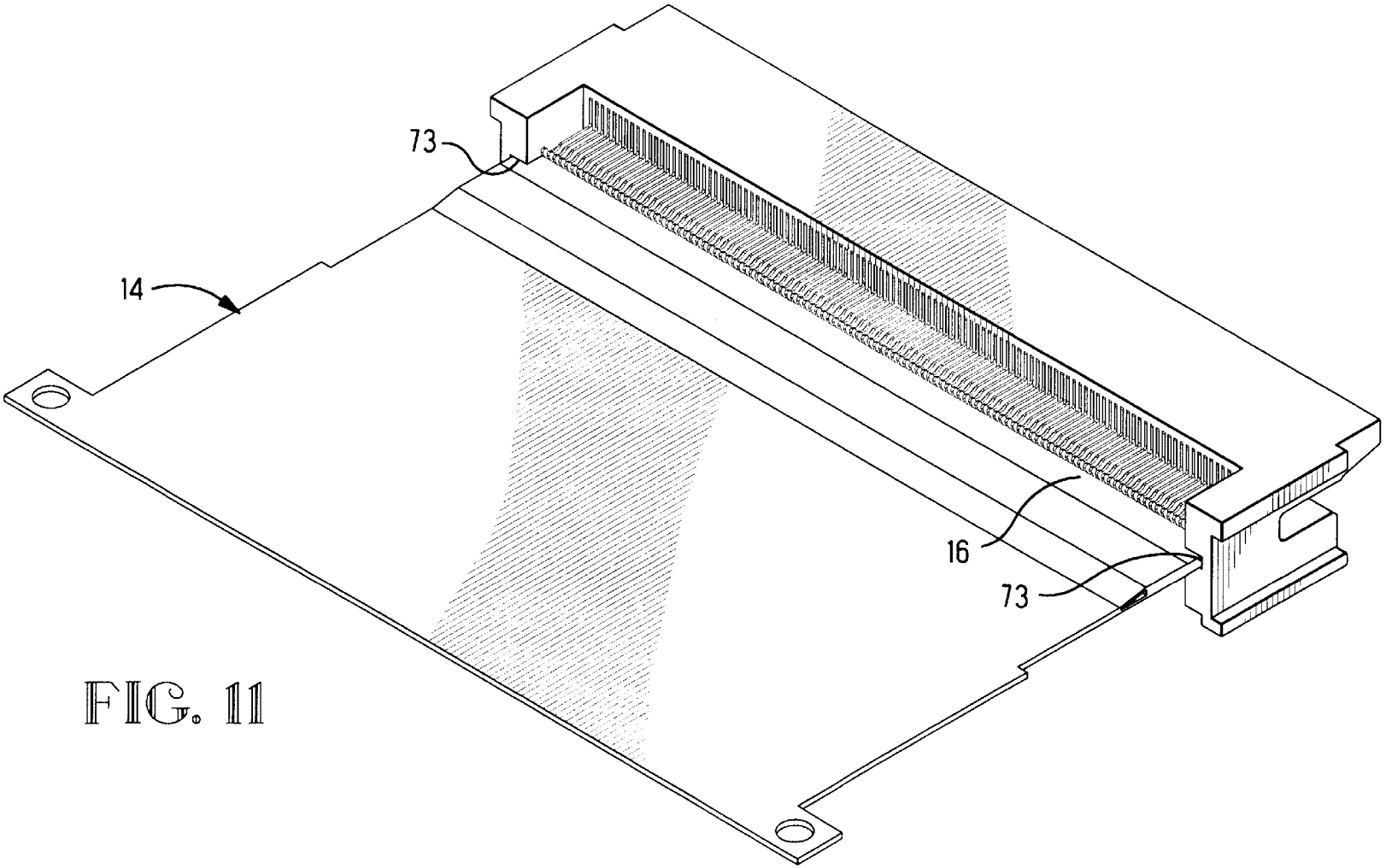
FIG. 11 is an isometric view of the second contact module shown in FIGS. 2, 5, and 7 with a conductive member terminated to electrical contacts.

One advantage of the present invention is the modular arrangement of both first and second contact modules within the electrical connector assembly. This modular arrangement allows electrical contacts to be loaded into the modular contact housings and conductors to be connected to the electrical contacts of both modules prior to the modules being inserted into the electrical connector assembly. FIGS. 10 and 11 show first and second contact modules, respectively, terminated to flexible etched circuitry prior to insertion into electrical connector housing 20. In FIG. 10, flexible etched circuitry 12 is surface mount soldered to solder tails 46 located along recessed surface 49. Similarly, in FIG. 11 flexible etched circuitry 14 is terminated to both rows of solder tails 56 and is seated in channels 73.

Although flexible etched circuitry 12 and 14 are illustrated in the present embodiment, various types of conductive media may be electrically interconnected to electrical contacts 44 and 54 of first and second contact modules. For instance, ribbon cable or flat flexible cable could easily substitute flexible etched circuitry without defeating the advantages of modularity in the present design.

Once conductors are terminated to first and second contact modules, the modules are inserted into the electrical connector housing in a tongue and groove arrangement which aligns and secures the modules within the housing. In the present embodiment, grooves 30*a* and 30*b* are located on the interior of the electrical connector housing 20 while tongues 41, 51*a* and 51*b* are provided on the first and second contact modules 40 and 50. Certainly, other equally advantageous alignment and securing means may be implemented without departing from the spirit of the invention. For example, the tongue and groove arrangement may be reversed such that tongues are provided on the interior of the electrical connector housing while grooves are located on the contact modules. Likewise, placement of the tongue and groove arrangement may be modified as may the number of cooperating tongues and grooves. Also, use of tongues at each end of contact modules 40 and 50 may in some instances be unnecessary in that the use of one tongue and groove at one end of the modules may be sufficient. Such variations to the alignment and securing arrangement would, of course, also hold true for retention member 60.

In the present embodiment, retention number 60 serves several functions. First, the retention member serves to secure both first and second contact modules firmly within electrical connector housing 20. Latching protrusions 64, in cooperation with latching detents 34, ensure a tight and secure assembly. Certainly, numerous latching arrangements may be implemented for securing the member 60 within electrical connector housing 20 while yielding equally desirable results. For example, protrusions could be provided on the interior of the electrical connector housing with complimentary detents being located on the retention member 60.

Another function served by retention member 60 is that of routing conductors, in this case flexible etched circuitry 12 and 14, from first and second contact modules, through the rear opening 22, and outside the electrical connector housing 20. To this end, central conductor routing slot 62 is provided in retention member 60 so that when first and second contact modules 40 and 50 are fully inserted into electrical connector housing 20, flexible etched circuitry 14 may be slid into central conductor routing slot 62 in a direction transverse to the insertion direction of the modules, while flexible etched circuitry 12 is received along recessed surface 69.

Yet another function served by retention member 60 is that of providing strain relief for conductors 12 and 14, thereby reducing the potential for fracture of solder joints located at solder tails 46 and 56.

It should be apparent that there may exist environments that do not demand wire dressing or strain relief nor require the added security of a latching retention member. In such environments it may be sufficient to provide retention means on the modules themselves rather than utilizing a separate retention member. This could be accomplished by using a latching protrusion and latching detent configuration similar to the one described on retention member 60 and electrical connector housing 20. This may be particularly desirable when it is critical to minimize the length of the electrical connector assembly.

It should be apparent from the foregoing description that the present invention provides a simple and advantageous electrical connector assembly for connection to an edge of a printed circuit board or circuit card. A modular assembly is achieved which allow conductors to be terminated to contact modules prior to their insertion into an insulative housing thus simplifying the assembly process.

The present invention also provides a simplified means of configuring a multi-row card edge connector. Although the present embodiment illustrates the use of three rows of contacts, more or less rows may also be used while still taking advantage of the modular design. Similarly, more or less modules may be used in the assembly of the present invention. For instance, a four row card edge connector could be assembled by using two opposed first contact modules and a second contact module inserted behind both first contact modules. Of course in accomplishing various different modular arrangements, different electrical contact shapes, sizes and placements employed as necessary.

A further advantage of the present invention is the simple and secure way in which the contact modules are aligned and retained within the electrical connector housing. A multi-function retention member is described which effectively secures contact modules within the electrical connector housing, while providing routing and strain relief of conductive members.

The electrical connector assembly of the present invention and many of its attendant advantages will be understood from the foregoing description. It is apparent that changes may be made in the form, construction, and arrangement of parts thereof without departing from the spirit of the invention, or sacrificing all of its material advantages. Thus, while the present embodiment of the invention has been disclosed, it is to be understood that the invention is not strictly limited to such embodiment but may be otherwise variously embodied and practiced within the scope of the appended claims.

What is claimed is:

1. An electrical connector for receiving a circuit card edge, comprising:

a housing having a mating end and a rear end, the mating end having a card receiving slot, the rear end having an opening leading to an internal cavity;

a first contact module disposed within the internal cavity proximate the mating end, the first contact module housing a plurality of electrical contacts, each electrical contact having a solder tail and a contact portion, the contact portion exposed on a side of the first contact module proximate the card receiving slot, the solder tail connected to a conductor which extends rearwardly through the opening in the rear end; and a second contact module disposed behind the first contact module within the internal cavity, the second contact module housing a plurality of electrical contacts, each electrical contact having a contact portion and a solder tail, the contact portion exposed on a surface of the second contact module proximate the card receiving slot, the solder tail connected to a conductor which extends rearwardly through the opening in the rear end.

2. The electrical connector of claim 1 further comprising a retention member which is inserted behind the second contact module within the opening in the rear end.

3. The electrical connector of claim 2, wherein the retention member has conductor passageways for allowing exit of the conductors through the retention member and out the opening in the rear end.

4. The electrical connector of claim 3, wherein the conductors are flexible etched circuitry.

5. The electrical connector of claim 4, wherein the retention member has a central conductor passageway in the form of a slot extending to an edge of the retention member for receiving flexible etched circuitry therethrough, and a recess on an exterior side of the retention member which cooperates with the interior of the housing to define a conductor passageway for receiving flexible etched circuitry connected to the first contact module therethrough.

6. The electrical connector of claim 2, wherein the retention member has a latching means which latches with the housing upon insertion into the opening in the rear end thereby securing the first contact module and the second contact module within the housing.

7. The electrical connector of claim 1 further comprising:

two opposing internal walls bounding the internal cavity having a first groove and a second groove disposed in parallel on each wall;

a tongue on each end of the first contact module for engagement with each first groove;

a pair of tongues on each end of the second contact module for engagement with each first groove and second groove.

8. The electrical connector of claim 7 further comprising a retention member having a pair of tongues on each end for engagement with each first and second groove, the retention member being disposed behind the second contact module within the opening in the rear end.

9. The electrical connector of claim 8, wherein the pair of tongues of the retention member have enlarged portions for interferingly fitting within the each first and second groove.

10. The electrical connector of claim 1, wherein the second contact module has latching means for engagement with a complementary latch member on the housing, whereby upon insertion of the second contact module into the internal cavity of the housing, both the first contact module and the second contact module are secured within the housing.

11. The electrical connector of claim 1, wherein the second contact module has a first row of electrical contacts opposing a second row of electrical contacts for engaging each side of the circuit card edge, the first row of contacts located behind the plurality of contacts of the first contact module.

12. The electrical connector of claim 11, wherein the conductors connected to the first contact module and the second contact module are flexible etched circuitry.

13. The electrical connector of claim 12, wherein the flexible etched circuitry connected to the first contact module exits the housing by passing beside the second contact module along an internal side of the housing and out the opening in the rear end, and wherein the flexible etched circuitry connected to the first row and second row of contacts located within the second contact module extend rearwardly back to back through a central portion of the opening in the rear end.

14. The electrical connector of claim 13, wherein the flexible etched circuitry connected to the second contact module provide connections to power and ground and wherein the flexible etched circuitry connected to the first contact module provide signal line connections.

15. An electrical connector assembly for electrical interconnection with a complementary electrical connector, the electrical connector assembly comprising:

a housing having a rear end, a mating end, and an internal cavity;

a first contact module housing a plurality of electrical contacts, the first contact module received within the internal cavity proximate the mating end; and a second contact module housing a plurality of electrical contacts, the second contact module received within the internal cavity adjacent to and rearward of the first contact module, the plurality of contacts of both the first contact module and second contact module positioned to make electrical interconnection with the complementary connector assembly.

16. The electrical connector assembly of claim 15, wherein the mating end is configured to receive a printed circuit board edge.

17. The electrical connector assembly of claim 16, wherein the plurality of electrical contacts of the first contact module and the second contact module have contact portions for electrically contacting the printed circuit board.

18. The electrical connector assembly of claim 15, further comprising a retention member for retaining the first contact module and second contact module within the housing and which is received within the internal cavity proximate the rear end and adjacent the second contact module.

19. The electrical connector assembly of claim 18, wherein the retention member has conductor passageways for routing conductors connected to the electrical contacts out the rear end of the housing.

20. The electrical connector assembly of claim 15, wherein the plurality of electrical contacts of both the first contact module and the second contact module have conductor connection portions which are terminated to conductors, and wherein the conductors are routed out the rear end of the housing.

* * * * *